US005507563A

United States Patent [19]

Arthur, Jr.

[11] Patent Number: 5,507,563

[45] Date of Patent: Apr. 16, 1996

[54] KNOCK-DOWN CHAIR

[75] Inventor: James R. Arthur, Jr., Monarch Beach, Calif.

[73] Assignee: Josan Corporation, Anaheim, Calif.

[21] Appl. No.: 159,616

[22] Filed: Dec. 1, 1993

[51] Int. Cl.[6] ..... A47C 7/00

[52] U.S. Cl. ..... 297/440.23; 297/452.2; 297/452.13

[58] Field of Search ..... 297/440.1, 440.11, 297/440.15, 440.2, 440.22, 440.23, 445, 449, 452.11, 452.12, 452.13, 452.16, 452.18, 452.19, 452.2, 452.48, 452.63, 452.64

[56] References Cited

U.S. PATENT DOCUMENTS

| | | | |
|---|---|---|---|
| 2,089,818 | 8/1937 | Terker | 297/440.23 X |
| 3,870,366 | 3/1975 | Rogers | 297/440.23 |
| 4,456,301 | 6/1984 | Apissomian | 297/445 |
| 4,848,843 | 7/1989 | Gibbs | 297/440.22 |
| 4,850,647 | 7/1989 | Engel | 297/445 X |
| 5,094,507 | 3/1992 | Gibbs | 297/440.1 |
| 5,224,760 | 7/1993 | Gibbs | 297/440.1 X |

*Primary Examiner*—Milton Nelson, Jr.
*Attorney, Agent, or Firm*—Pollock, Vande Sande & Priddy

[57] ABSTRACT

A chair assembly having a seat and back frame detachably held on a base frame, which includes a pair of spaced-apart side frame members held parallel to each other by a plurality of crossbar members. The seat and back frame are secured to the base frame by retaining blocks mounted on the back frame which engage two parallel crossbar members.

4 Claims, 4 Drawing Sheets

KNOCK-DOWN CHAIR

FIELD OF THE INVENTION

The present invention relates to furniture and more particularly to chairs, the components of which can readily be assembled or dissembled without the use of tools.

BACKGROUND OF THE INVENTION

It has long been recognized that furniture which can be provided unassembled can save storage space and shipping costs. However, the design of some furniture pieces may require specialized knowledge or specialized tools to assemble the components, which in turn may then require detailed multi-language instructions be furnished to the person assembling the furniture.

Chairs in particular present a problem in that their use in supporting a human body, whose weight may exceed 200 pounds, requires that the chair, including the means holding the assembled pieces together, be sturdy.

SUMMARY OF THE INVENTION

It is accordingly one object of the present invention to provide a chair which can readily be assembled and disassembled without the use of tools.

It is still another object of the present invention to provide a chair which combines light weight, high strength and rigidity.

In accordance with the present invention there is provided a chair having an interchangeable seat and back assembly comprising a base frame for supporting the chair on a floor, an upper seat and back frame supported by the base frame, user support means, secured to the seat and back frame for supporting an occupant of the chair, and means secured to the seat and back frame for detachably securing the seat and back frame to the base frame.

The base frame includes a pair of spaced-apart parallel side members and front and rear rod members which extend between and are integrally fixed to the side members.

The seat and back frame includes a pair of spaced-apart, L-shaped rail members configured to define a substantially horizontal seat portion and an upwardly-extending back portion, and strut means to extend between and secured to the spaced-apart rail members.

The present invention combines lightweight sturdiness and high strength. In addition, the seat and back frame is readily attached to or detached from the base frame. This is especially advantageous to a retailer who can offer a wide variety of combinations of designs and configurations of the base frame without carrying a large inventory of chairs. Further, the design of the seat and back frame permits a large number of them to be stacked on top of each other in a relatively small space.

DETAILED DESCRIPTION OF THE INVENTION

Figure 8:
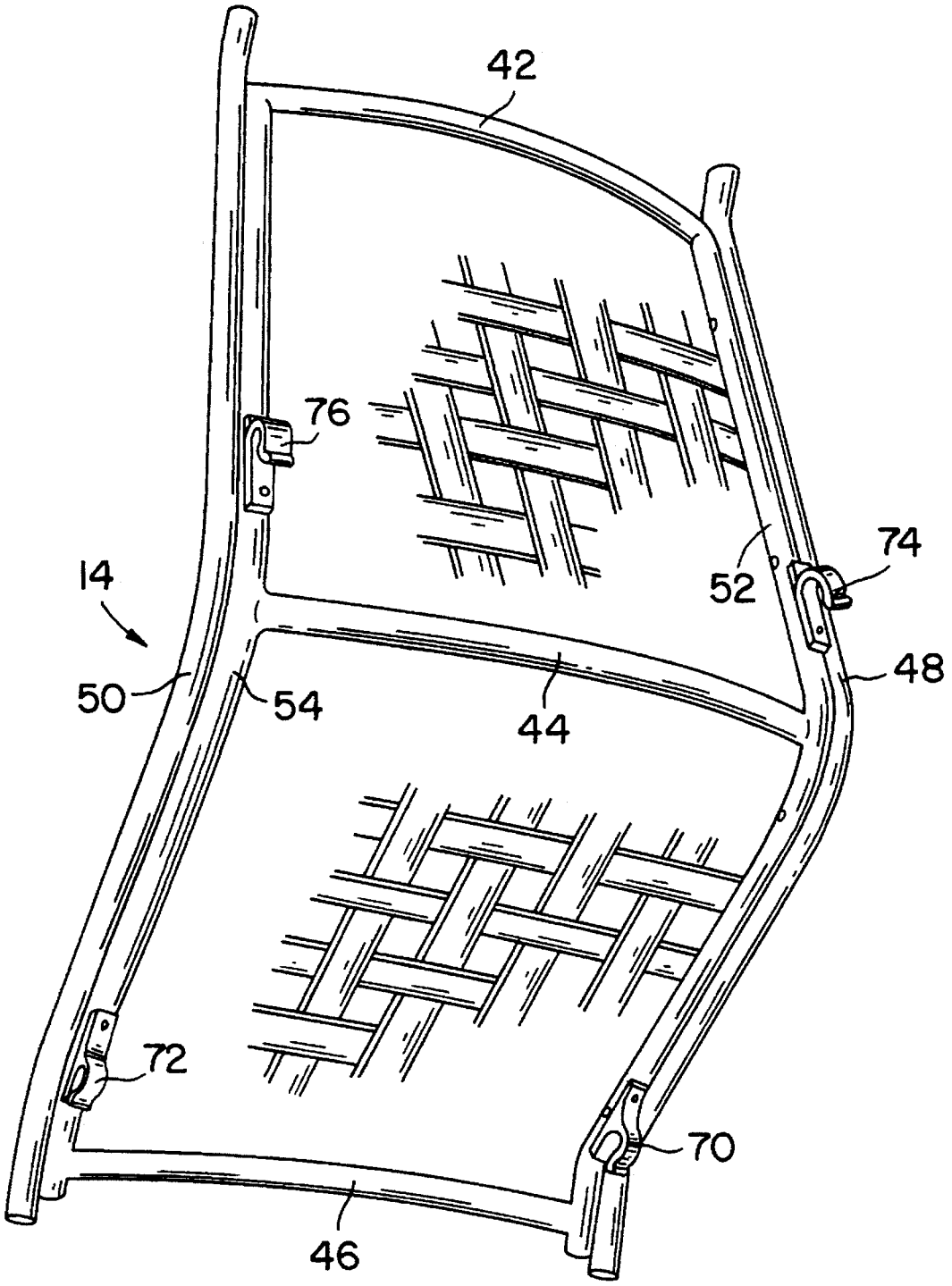
FIG. 8 is a perspective view from the underside of the seat and back frame of FIG. 1 showing a lattice of straps for supporting an occupant.

The present preferred embodiments may be incorporated in a wide variety of chair types including those chairs referred to as strap chairs, cushion chairs and sling chairs. Strap chairs include those chairs in which an occupant is supported directly by straps or strips of material which extend from side to side and longitudinally to form a lattice or criss-cross pattern as shown in FIG. 8.

Cushion chairs include those chairs in which cushions are supported by straps arranged as in a strap chair or by straps extending only from side-to-side as in shown in design patent D.E. 339,696 issued Sep. 28, 1993 in the name of James R. Arthur, Jr.

The present invention will be described in more detail as it is applicable to those chairs referred to as sling chairs. Workers of ordinary skill in the art will readily be able to apply the teaching herein to chairs of other types.

Figure 1:
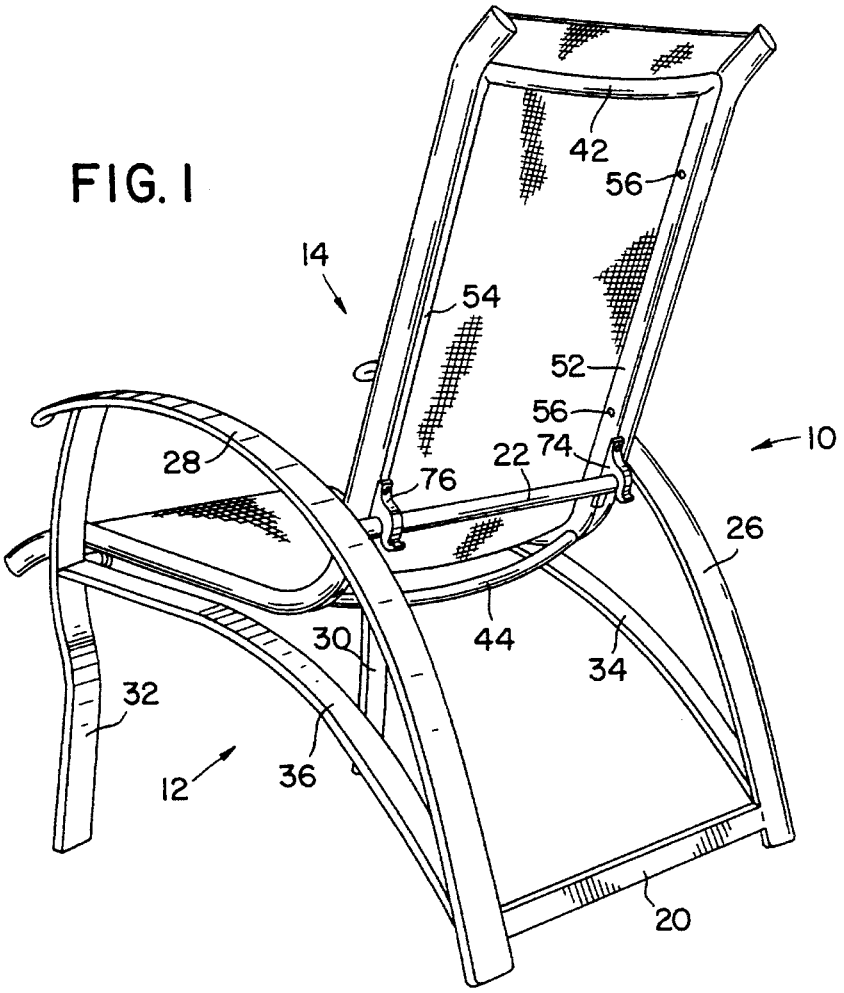
FIG. 1 is a perspective view of one embodiment of the present invention.
Figure 2:
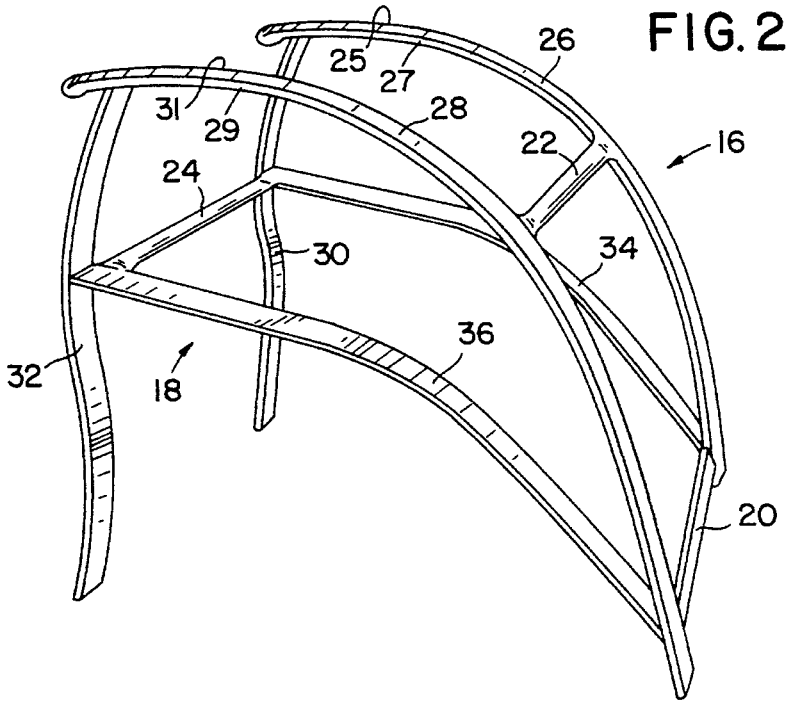
FIG. 2 is a perspective view of the base frame of FIG. 1.
Figure 3:
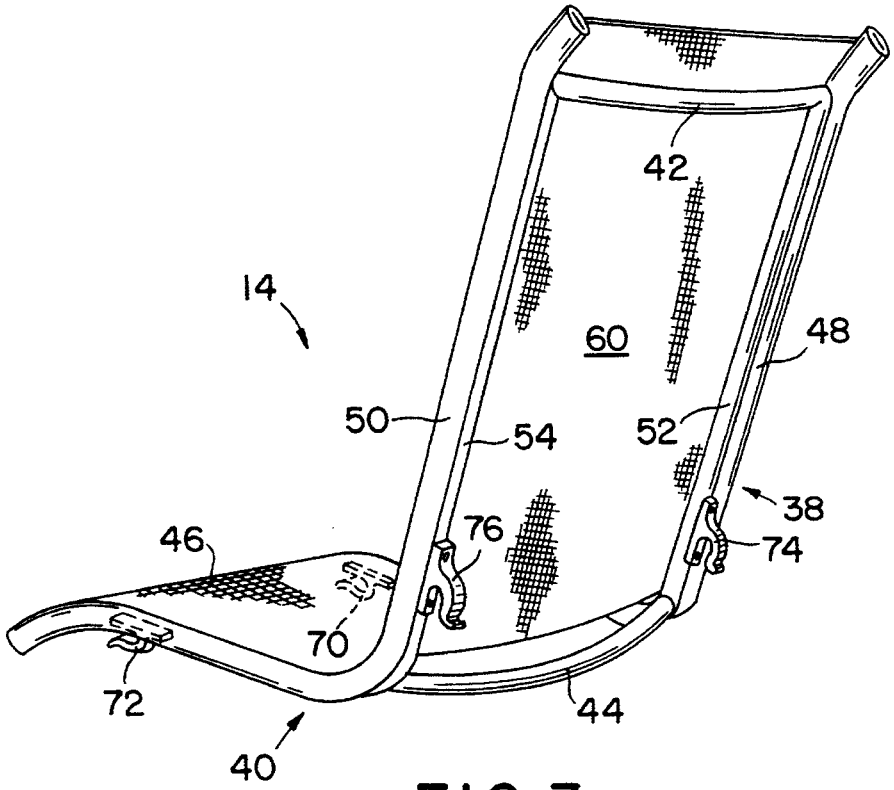
FIG. 3 is a perspective view of the seat and back frame of FIG. 1.

Referring to the drawings, FIGS. 1–3 show, as one embodiment of the present invention, an assembled chair 10 having a base frame 12 which supports a fabric-covered seat and back frame 14. Base frame 12 includes a pair of spaced-apart side frame members 16, 18 which are held parallel to each other by crossbars 20, 22, 24.

Side frame members 16, 18 comprise upper channel members 26, 28, front leg members 30, 32 and lower channel members 34, 36 which extend between the lower ends of upper channel members 26, 28 and a position intermediate the upper and lower ends of leg members 30, 32. The channel members are preferably identical in cross-section and preferably have substantially flat upper and lower surfaces connected together with rounded edge portions. A typically useful cross-section has a width of about 2 to about 2¾ inches and a depth of about ⅜ to about ⅝ inches.

The channel members may be made of polymeric material but the preferred embodiments are fabricated from a metal such as steel and most preferably are made of aluminum and are secured together with welds.

Crossbar members 22, 24 are preferably made of tubular aluminum stock having for example, an O.D. of ⅞ inch and a wall thickness of about 1/16 inch. As will be described in detail, the external diameters of crossbar members 22, 24 are dimensioned to cooperate with the means for retaining seat and back frame 14 on base frame 12. Cross bar member 20 may be circular in cross section or it may have another shape such as having an oval or rectangular cross-section. Crossbar members 20, 22, 24 are secured to side frame members 16, 18 by welding their ends to the inner surfaces of the side frame members.

Seat and back frame member 14 comprises side rail members 38, 40 which are held in spaced-apart parallel arrangement with upper, intermediate and lower strut members 42, 44, 46. As shown in FIGS. 3 and 8, side rail members 38, 40 comprise outer tubular members 48, 50 and inner tubular members 52, 54. In a preferred embodiment of the present invention, strut members 42, 44, 46 are bowed away from the fabric 60 and are affixed to the inner tubular members 52, 54 by welding to form a rigid inner framework having an outer periphery defined by strut members 42 and 46 and inner tubular members 52, 54. The resulting inner framework is secured to outer tubular members 48, 50 by fastening means, preferably a plurality of screws 56 passing through inner tubes 52, 54 into outer tubular members 48, 50.

Figure 6:
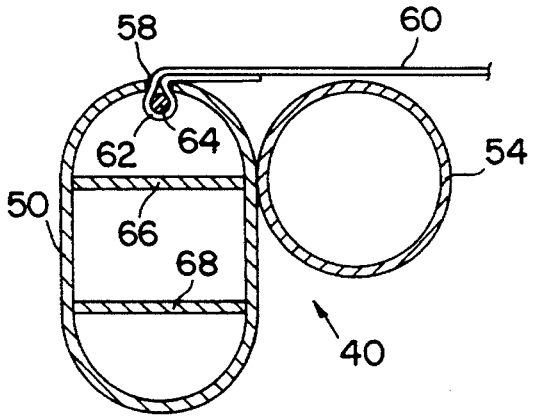
FIG. 6 is a sectional view of fabric secured in place to the seat and back frame.

As shown in cross section in FIG. 6, in a preferred embodiment of the present invention an outer tubular member 50 is provided with a longitudinal slot 58 for insertion of fabric 60 which passes around reed member 64 to retain the end portion 62 of fabric 60 in place within tubular member 50. Outer tubular members 48, 50 as represented by tubular member 50 in FIG. 6 have a non-circular cross-section, and are provided with reinforcing members 66, 68. Fabric 60 may be provided in a variety of colors, color combinations, and material, being limited only by the imagination of the designer.

Figure 7:
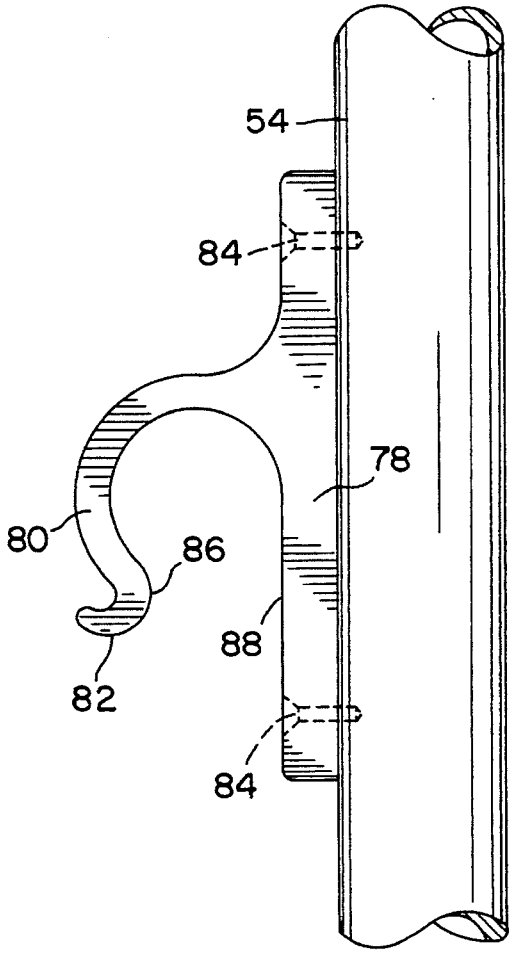
FIG. 7 is a side view of the fastening means shown in FIGS. 1, 3 and 8.

As shown in FIGS. 1, 3 and 8, inner tubular members 52, 54 are provided with retaining blocks 70, 72, 74 and 76 for reasonably securing seat and back frame member 14 to base frame 12. As shown in FIG. 7 a preferred embodiment of a retaining block comprises a base portion 78, and a hook portion 80 which has a lip portion 82. The retaining blocks are preferably formed of a polymeric material, are secured to inner tubular members 52, 54 by screws or rivets 84 and are positioned to engage crossbars 22, 24 of base frame 12. Hook portion 80 is configured to snap in place on the crossbars 22, 24, the distance between surface 86 of hook portion 80 and surface 88 of base portion 78 being less than the diameter of crossbars 22, 24. A typically useful distance from surfaces 86 and 88 for easy assembly and secure retention of the retaining blocks on the crossbars is about ⅛ inch less than the diameter of cross bars 22, 24. For example, a dimension of ¾ inch O.D. for crossbars having a diameter of ⅞ inch has proved to be useful.

Figure 4:
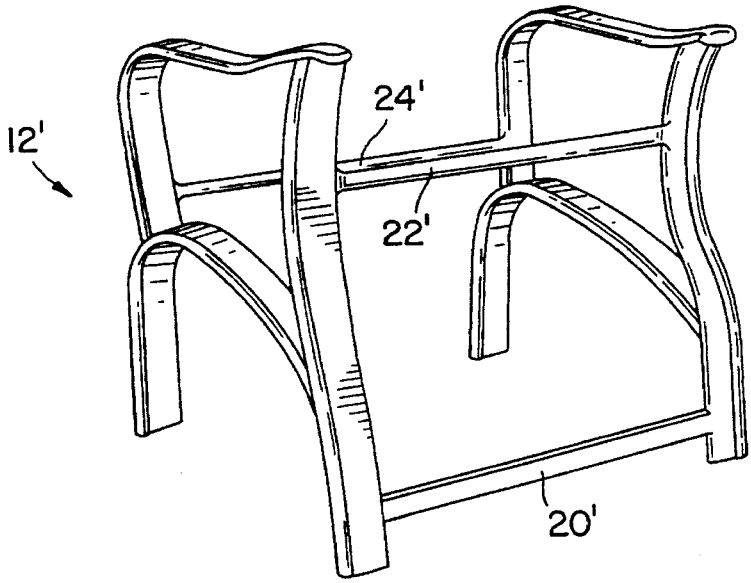
FIG. 4 is a perspective view of a base frame of another embodiment of the present invention.
Figure 5:
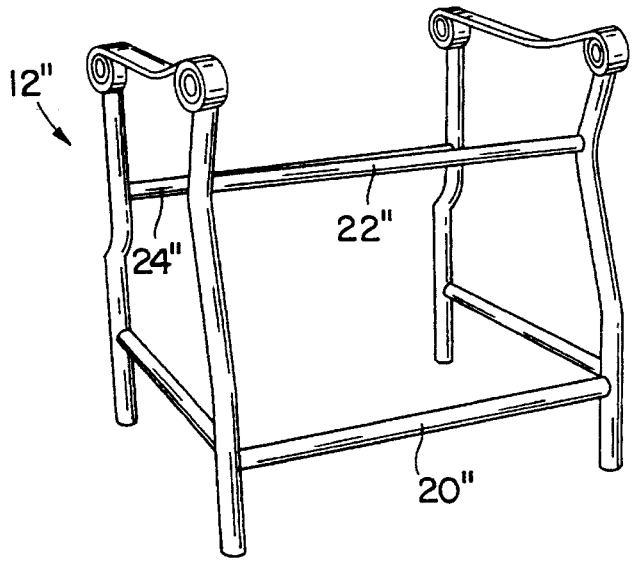
FIG. 5 is a perspective view of a base frame of still another embodiment of the present invention.

FIGS. 4 and 5 show base frame modifications 12' and 12" which may be substituted for base frame 12 of FIG. 1. As shown in FIG. 4, base frame 12' includes cross bars 22', 24' which are spaced-apart for engaging retaining blocks 70, 72, 74, 76 of seat and back frame 14. Similarly, the base frame 12" of FIG. 5 includes cross bars 22", 24" for engaging retaining blocks which are mounted on a seat and back frame member.

The foregoing description is intended to illustrate and not to limit the present invention, and it is applicant's intention to cover all modifications which come within the scope of the invention which is to be limited only by the claims appended hereto.

What is claimed is:

1. A chair comprising a base frame for supporting the chair on a floor, a seat and back frame supported by said base frame, and means secured to the seat and back frame for supporting a user of the chair, wherein:

a) said base frame comprises a pair of spaced-apart, parallel side members, and a front rod member and a rear rod member extending between and integrally fixed to said side members;

b) said seat and back frame comprises a pair of spaced-apart, parallel, substantially L-shaped rail members configured to define a substantially horizontal seat portion and an upwardly extending back portion and a plurality of strut members extending between and integrally fixed to said rail members, each of said L-shaped rail members comprising an inner tubular member and an outer tubular member in contact with and secured to said inner tubular member along an entire length of said inner tubular member;

c) means for securing a fabric in place between said L-shaped rail members; and d) a plurality of retaining blocks secured to each of said rail members for detachably securing said seat and back frame to said base frame, said retaining blocks being supported by said inner tubular member of said L-shaped rail members.

2. A chair according to claim 1, wherein each of said retaining blocks comprises a base portion, and a hook portion integral with said base portion and defining an opening for engaging one of said rod members, said base portion being secured to one of said rail members.

3. A chair according to claim 1, wherein said retaining blocks are made of plastic.

4. A chair according to claim 1, with means capable of supporting a cushion.

* * * * *